US011753928B2

(12) United States Patent
Breaux et al.

(10) Patent No.: US 11,753,928 B2
(45) Date of Patent: Sep. 12, 2023

(54) MECHANICAL METHOD FOR MAPPING A BOREHOLE SHAPE USNG A DRILLING TOOL

(71) Applicant: Halliburton Energy Services, Inc., Houston, TX (US)

(72) Inventors: Brian Breaux, Houston, TX (US); Michael Dewayne Finke, Houston, TX (US); John R. Hardin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/570,062

(22) Filed: Jan. 6, 2022

(65) Prior Publication Data

US 2023/0212940 A1 Jul. 6, 2023

(51) Int. Cl.

| | |
|---|---|
| ***E21B 47/08*** | (2012.01) |
| ***E21B 17/10*** | (2006.01) |
| ***E21B 47/13*** | (2012.01) |

(52) U.S. Cl.

CPC ..... *E21B 47/08* (2013.01); *E21B 17/1014* (2013.01); *E21B 47/13* (2020.05)

(58) Field of Classification Search

CPC ..... E21B 47/08; E21B 47/13; E21B 17/1074
See application file for complete search history.

(56) References Cited

U.S. PATENT DOCUMENTS

| | | | | |
|---|---|---|---|---|
| 4,715,469 | A | 12/1987 | Yasuda et al. | |
| 5,105,881 | A * | 4/1992 | Thoms | E21B 47/08 166/250.01 |
| 11,174,682 | B2 | 11/2021 | Doud et al. | |
| 2010/0108386 | A1 | 5/2010 | Martinez et al. | |
| 2014/0083771 | A1 | 3/2014 | Clark | |
| 2018/0196005 | A1 | 6/2018 | Fanini et al. | |
| 2020/0332599 | A1 | 10/2020 | Doud et al. | |
| 2020/0332607 | A1 | 10/2020 | Panda et al. | |
| 2021/0340820 | A1 | 11/2021 | Hagar et al. | |

FOREIGN PATENT DOCUMENTS

| | | |
|---|---|---|
| CN | 203231734 U | 3/2013 |
| WO | 8502674 A | 6/1985 |

OTHER PUBLICATIONS

Foreign Communication from Related Application—International Search Report and Written Opinion of the International Searching Authority, International Application No. PCT/US2022/011702, dated Sep. 27, 2022, 10 pages.

* cited by examiner

*Primary Examiner* — Yong-Suk (Philip) Ro
(74) *Attorney, Agent, or Firm* — Conley Rose, P.C.; Rodney B. Carroll

(57) ABSTRACT

The disclosure provides for a bottom hole assembly that comprises a housing and a caliper arm. The caliper arm is pivotally coupled to the housing at a hinge disposed within the housing, wherein the caliper arm is operable to rotate about the hinge between a first position within the housing and a second position external to the housing. The bottom hole assembly further comprises a linear actuator coupled to the caliper arm and operable to extend the caliper arm to the second position, wherein the caliper arm is biased to remain in the second position in contact with a borehole wall. The bottom hole assembly further comprises a sensor disposed within the housing and operable to monitor a position of the caliper arm.

20 Claims, 8 Drawing Sheets

MECHANICAL METHOD FOR MAPPING A BOREHOLE SHAPE USNG A DRILLING TOOL

TECHNICAL FIELD OF THE INVENTION

The present disclosure relates generally to wellsite operations and, more particularly, to systems and methods for mapping a borehole shape using a drilling tool.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. In drilling wells for oil and gas exploration, understanding the structure and properties of the associated geological formation provides information to aid such exploration. Measurements in a borehole are typically performed to attain this understanding after drilling, via a wireline tool. Measuring while drilling presents many challenges, including maintaining tool integrity throughout drilling conditions.

Figure 1:
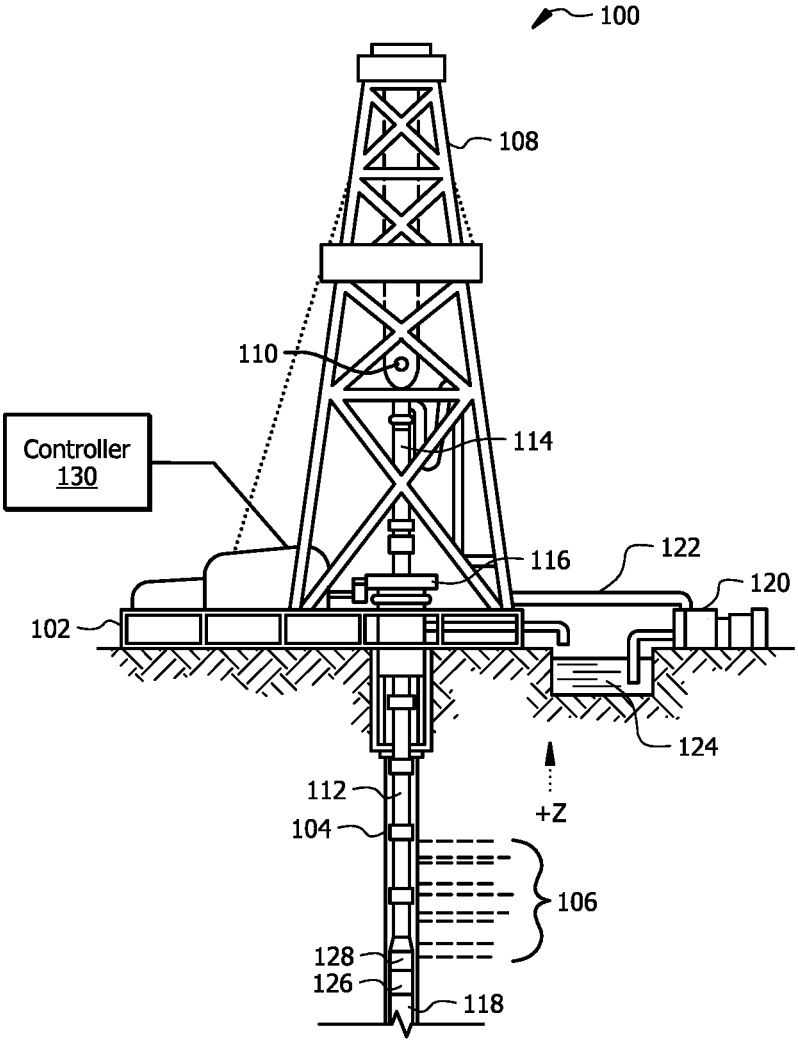
FIG. 1 is a schematic diagram of a drilling system at a well site, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments described below with respect to one implementation are not intended to be limiting.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides for systems and methods enabling a downhole drilling tool to measure the geometry of a borehole through a mechanical method. In embodiments, the drilling environment is much more violent than a wireline operating environment. Wireline mechanisms for mapping the shape of a borehole are typically composed of relatively delicate articulating linkages which are not rugged enough to survive drilling conditions. The present disclosure provides for the ability of a drilling tool to rotate. Because the drilling tool rotates, it may adequately capture the shape of a borehole while using fewer mechanical mechanisms. The rotation of the tool may sweep a mechanical device across the complete surface of the borehole wall, as opposed to a wireline tool which does not typically rotate. The tool may comprise fewer mechanisms, which may be an advantage because this allows the design to devote more volumetric capacity of the tool towards ruggedizing the mechanism. This may be needed in a drilling tool because significant volume must be reserved for the tool's base structure in order to enable survival in drilling conditions.

FIG. 1 is a schematic diagram of an exemplary drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106. In other embodiments, such as in an offshore drilling operation, a volume of water may separate the drilling platform 102 and the wellbore 104. Even though FIG. 1 depicts a land-based drilling platform 102, it will be appreciated that the embodiments of the present disclosure are equally well suited for use in other types of drilling platforms, such as offshore platforms, or rigs used in any other geographical locations. The present disclosure contemplates that wellbore 104 may be vertical, horizontal or at any deviation.

The drilling system 100 may include a derrick 108 supported by the drilling platform 102 and having a traveling block 110 for raising and lowering a conveyance 112, such as a drill string. A kelly 114 may support the conveyance 112 as it is lowered through a rotary table 116. In one or more embodiments, a top drive (not shown) may be used in place of the kelly 114 and rotary table 116. A drill bit 118 may be coupled to the conveyance 112 and driven by a downhole motor and/or by rotation of the conveyance 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of conveyance 112, through orifices in the drill bit 118, back to the surface via the annulus defined around conveyance 112, and into a retention pit 124. The drilling fluid cools the drill bit 118 during operation and transports cuttings from the wellbore 104 into the retention pit 124.

The drilling system 100 may further include a bottom hole assembly (BHA) 126 coupled to the conveyance 112 near the drill bit 118. The BHA 126 may comprise various downhole measurement tools such as, but not limited to, measurement-while-drilling (MWD) and logging-while-drilling (LWD) tools, which may be configured to take downhole measurements of drilling conditions.

As the drill bit 118 extends the wellbore 104 through the formations 106, the BHA 126 may continuously or intermittently transmit signals and receive back signals relating to a parameter of the formations 106, for example, impulse signals such as Wicker wavelet, Blackman pulse or its higher order time derivatives, as well as chirp signals, etc. The BHA 126 may be communicably coupled to a telemetry module 128 used to transfer measurements and signals from the BHA 126 to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the BHA 126 may also be stored within the BHA 126 or the telemetry module 128 for later retrieval at the surface upon retracting the conveyance 112.

As illustrated, a controller 130 for controlling, processing, storing, and/or visualizing the measurements gathered by the BHA 126 may be included in the drilling system 100. The controller 130 may be communicably coupled to the BHA 126 by way of the conveyance 112. In one or more embodiments, the controller 130 may be disposed about any suitable location in the drilling system 100. In alternate embodiments, controller 130 may be located remotely from the system 100. The controller 130 may be directly or indirectly coupled to any one or more components of the drilling system 100.

Figure 2:
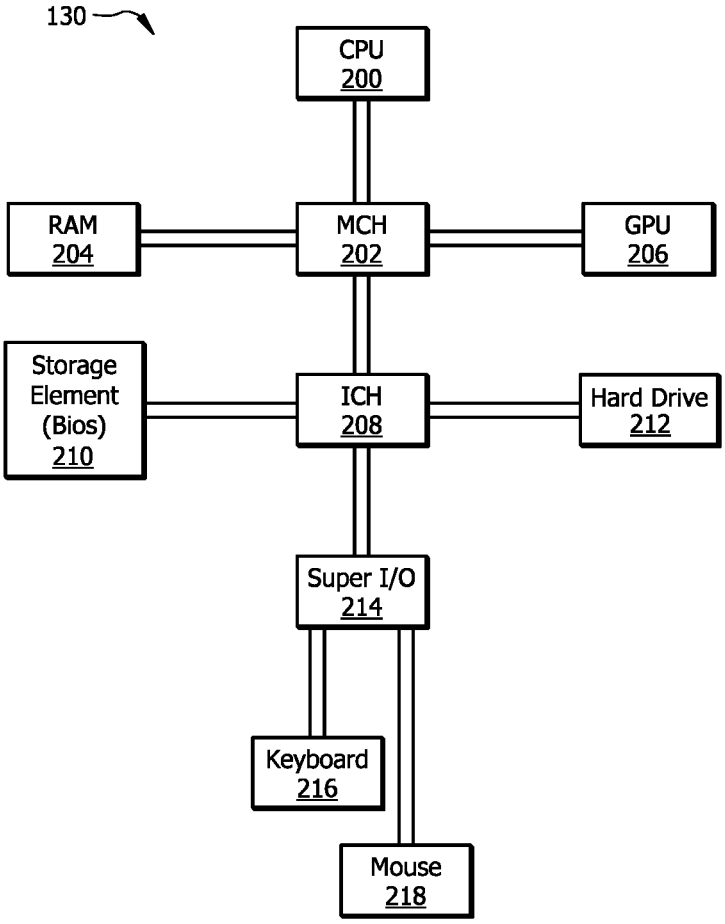
FIG. 2 is a diagram illustrating an example controller, according to aspects of the present disclosure.

FIG. 2 is a diagram illustrating an example controller 130, according to aspects of the present disclosure. A processor or central processing unit (CPU) 200 of the controller 130 is communicatively coupled to a memory controller hub or north bridge 202. The processor 200 may include, for example a microprocessor, microcontroller, digital signal processor (DSP), application specific integrated circuit (ASIC), or any other digital or analog circuitry configured to interpret and/or execute program instructions and/or process data. Processor 200 may be configured to interpret and/or execute program instructions or other data retrieved and stored in any memory such as memory 204 or hard drive 212. Program instructions or other data may constitute portions of a software or application for carrying out one or more methods described herein. Memory 204 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 204 for execution by processor 200.

Modifications, additions, or omissions may be made to FIG. 2 without departing from the scope of the present disclosure. For example, FIG. 2 shows a particular configuration of components of controller 130. However, any suitable configurations of components may be used. For example, components of controller 130 may be implemented either as physical or logical components. Furthermore, in some embodiments, functionality associated with components of controller 130 may be implemented in special purpose circuits or components. In other embodiments, functionality associated with components of controller 130 may be implemented in configurable general-purpose circuit or components. For example, components of controller 130 may be implemented by configured computer program instructions.

Memory controller hub (MCH) 202 may include a memory controller for directing information to or from various system memory components within the controller 130, such as memory 204, storage element 210, and hard drive 212. The memory controller hub 202 may be coupled to memory 204 and a graphics processing unit (GPU) 206. Memory controller hub 202 may also be coupled to an I/O controller hub (ICH) or south bridge 208. I/O controller hub 208 is coupled to storage elements of the controller 130, including a storage element 210, which may comprise a flash ROM that includes a basic input/output system (BIOS) of the computer system. I/O controller hub 208 is also coupled to the hard drive 212 of the controller 130. I/O controller hub 208 may also be coupled to a Super I/O chip 214, which is itself coupled to several of the I/O ports of the computer system, including keyboard 216 and mouse 218.

In certain embodiments, the controller 130 may comprise at least a processor and a memory device coupled to the processor that contains a set of instructions that when executed cause the processor to perform certain actions. In any embodiment, the controller 130 may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The controller 130 may include random access memory (RAM), one or more processing resources such as a central processing unit (CPU) or hardware or software control logic, read only memory (ROM), and/or other types of nonvolatile memory. Additional components of the controller 130 may include one or more disk drives, one or more network ports for communication with external devices as well as various input and output (I/O) devices, such as a keyboard, a mouse, and a video display. The controller 130 may also include one or more buses operable to transmit communications between the various hardware components.

Figure 3:
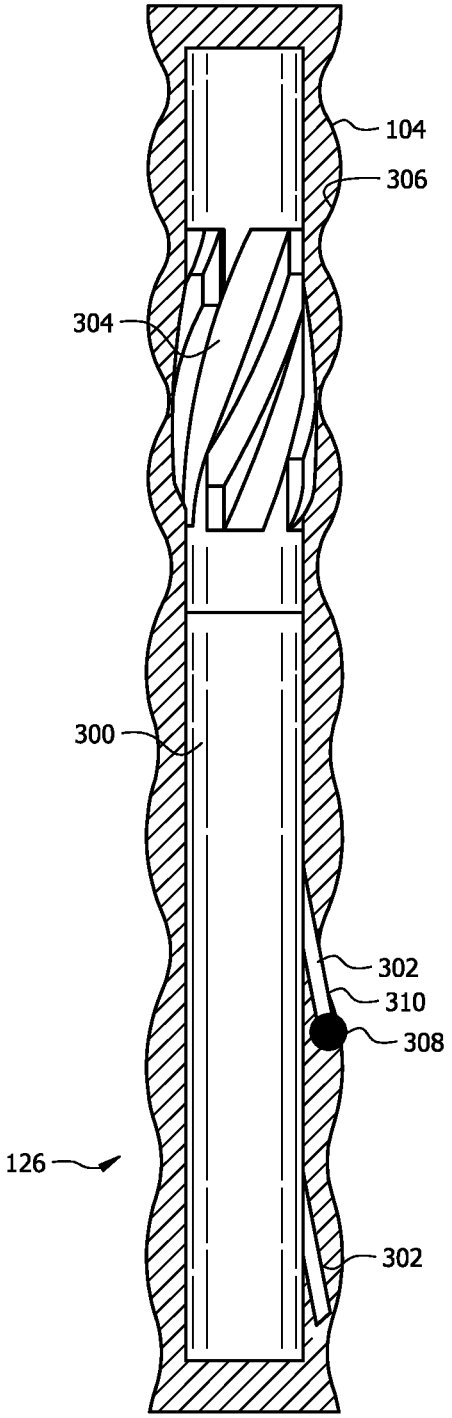
FIG. 3 is a diagram illustrating an example bottom hole assembly, according to aspects of the present disclosure.

FIG. 3 is a diagram illustrating an example BHA 126. The BHA 126 may comprise any suitable equipment, sensors, electronics, and the like operable to perform one or more operations and/or to take measurements downhole. As illustrated, the BHA 126 may comprise a housing 300 and a caliper arm 302. The housing 300 may be any suitable size, height, shape, and any combinations thereof. Further, the housing 300 may comprise any suitable materials, such as metals, nonmetals, polymers, composites, and any combinations thereof. The housing 300 may be operable to protect any sensors, equipment, circuitry, and the like from an external environment. In one or more embodiments, the housing 300 may be incorporated as part of the conveyance 112 (referring to FIG. 1). As illustrated, a stabilizer 304 may be disposed adjacent to the housing 300 and operable to centralize the housing 300 within the wellbore 104. The stabilizer 304 may be any suitable size, height, length, shape, and any combination thereof. The stabilizer 304 may be operable to protect the housing 300, and other components of the conveyance 112, from contact with a borehole wall 306. While the stabilizer 304 is illustrated as being uphole from housing 300, stabilizer 304 may also be disposed downhole from housing 300.

Figure 4A:
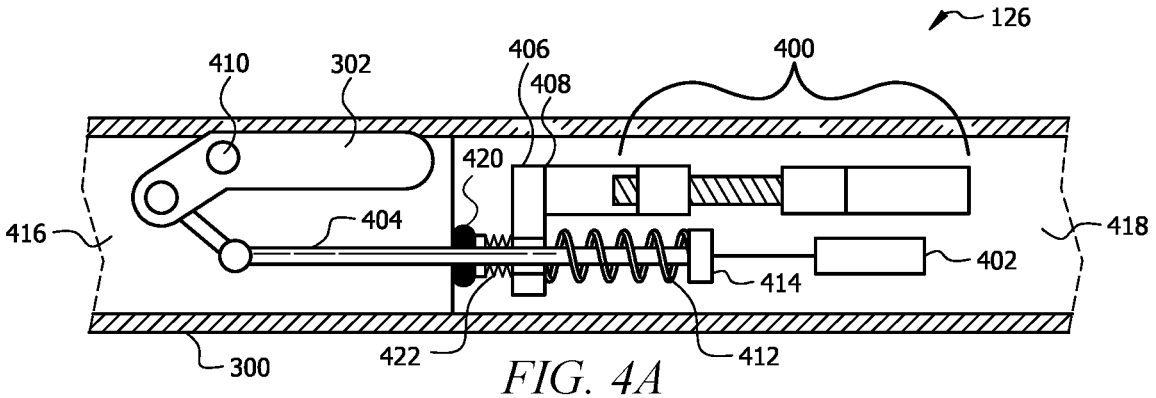
FIG. 4A is a diagram illustrating an example caliper arm in a first position within a housing, according to aspects of the present disclosure.
Figure 4B:
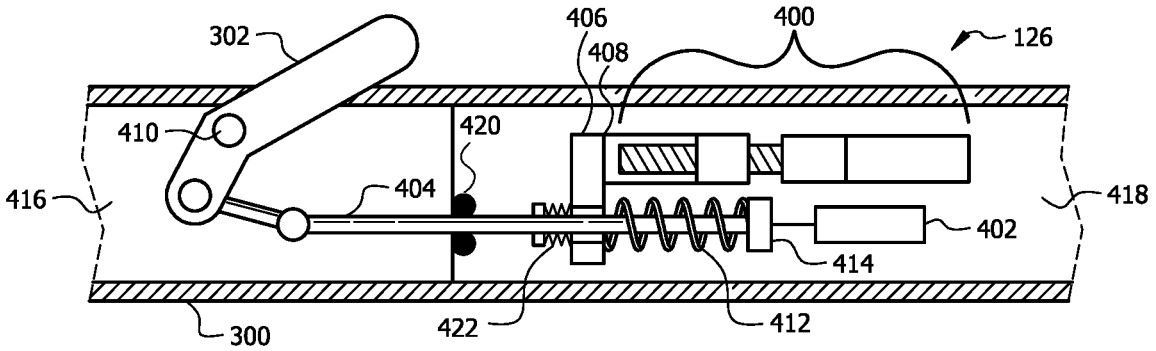
FIG. 4B is a diagram illustrating an example caliper arm in a second position extended away from a housing, according to aspects of the present disclosure.
Figure 4C:
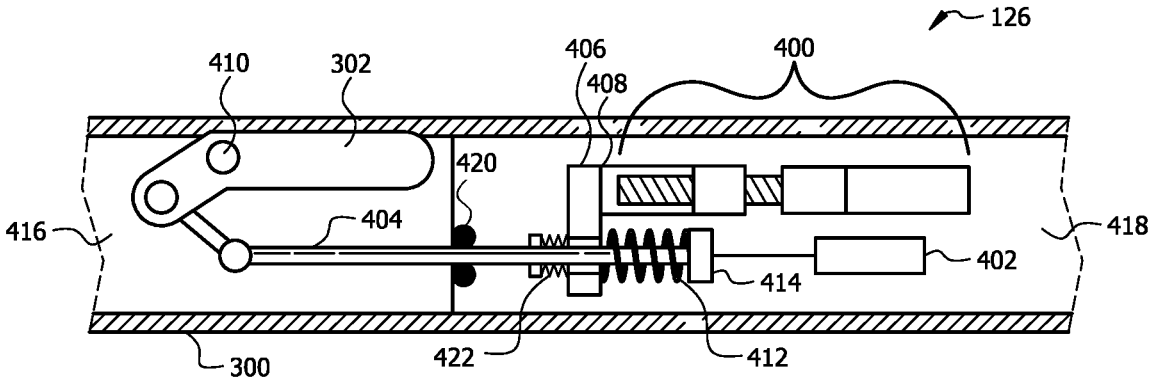
FIG. 4C is a diagram illustrating an example caliper arm in a second position and forced towards a housing, according to aspects of the present disclosure.

The caliper arm 302 may be at least partially disposed within the housing 300. The caliper arm 302 may be operable to extend from a first position within the housing 300 to a second position external to and away from the housing 300. In one or more embodiments, the caliper arm 302 may extend radially or tangentially with respect to the housing 300, depending on how the caliper arm 302 is positioned along the housing 300. In embodiments, the caliper arm 302 may be pivotally coupled to the housing at a hinge (for example, hinge 410 as shown in FIGS. 4A-4C) and operable to rotate about the hinge. Without limitations, the caliper arm 302 may be coupled to the housing 300 through any suitable method, including through the usage of fasteners, adhesives, interlocking components, interference fit, and any combination thereof. The caliper arm 302 may comprise any suitable size, height, shape, and any combinations thereof. Further, the caliper arm 302 may comprise any suitable materials, such as metals, nonmetals, polymers, composites, and any combinations thereof. In embodiments, there may be a plurality of caliper arms 302 disposed along the housing 300. Each caliper arm 302 may be disposed in a uniform fashion, according to a pattern, or randomly along the housing 300. Each caliper arm 302 may be actuated to extend from the housing to contact the borehole wall 306. As illustrated, the caliper arm 302 may be configured to extend radially outwards to form an angle with reference to the length of the housing 300 pointing downhole. In other embodiments, the caliper arm 302 may be configured to extend radially outwards to form an angle with reference to the length of the housing 300 pointing uphole.

During operations, the caliper arm 302 may be actuated to extend outwards in order to contact the borehole wall 306. The caliper arm 302 may be pre-loaded or biased in the extended, second position away from the housing 300 in order to maintain contact with the borehole wall 306. In certain embodiments, a ball 308 may be disposed at a distal end 310 of the caliper arm 302 operable to rotate when in contact with the borehole wall 306. The ball 308 may reduce abrasion and wear for the caliper arm 302. In one or more embodiments, any suitable component operable to roll against a surface may be used as the ball 308. For example, and without limitations, a wheel or roller may be used as the ball 308. In embodiments, the caliper arm 302 may maintain contact with the borehole wall 306 as the BHA 126 travels downhole during drilling operations and/or as the conveyance 112 is pulled up after completing a drilling operation. As the caliper arm 302 is displaced downhole and/or uphole, the BHA 126 may be operable to measure a shape of the borehole wall 306. In embodiments wherein a restriction decreases a portion of a perimeter of the borehole wall 306, the caliper arm 302 may be actuated to displace closer to the housing 300. In embodiments wherein a portion of the perimeter of the borehole wall 306 is enlarged, the caliper arm 302 may be actuated to extend further away from the housing 300. During operations, the BHA 126 may be operable to measure the shape of the borehole wall 306 based on the displacement of the caliper arm 302. In one or more embodiments, as the BHA 126 rotates during operations, a single caliper arm 302 may be capable of providing measurements corresponding to an approximation of the perimeter of the borehole wall 306 for at least a portion of the length of the wellbore 104 (referring to FIG. 1).

FIGS. 4A-4C are diagrams illustrating an example BHA 126 in operation. FIG. 4A illustrates the caliper arm 302 in the first position within the housing 300. FIG. 4B illustrates the caliper arm 302 in the second position extended away from the housing 300. FIG. 4C illustrates the caliper arm 302 in the second position but forced back towards the housing 300 due to some external structure in the wellbore 104 (referring to FIG. 1). With reference to each of FIGS. 4A, 4B, and 4C, the BHA 126 may comprise a linear actuator 400, a sensor 402, and a linkage 404. The linear actuator 400 may be coupled to the caliper arm 302 and operable to extend the caliper arm 302 to the second position, wherein the caliper arm 302 is biased to remain in the second position in contact with the borehole wall 306 (referring to FIG. 3). The linear actuator 400 may comprise any suitable size, height, shape, and any combinations thereof. Further, the linear actuator 400 may comprise any suitable materials, such as metals, nonmetals, polymers, composites, and any combinations thereof. In embodiments, any suitable actuator operable to provide a linear force may be used as the linear actuator 400. In view of the present figures, the linear actuator 400 may comprise a motor, gear reducer, and ball screw. The motor may drive the gear reducer, wherein the output torque may actuate the ball screw to extend or retract. Without limitations, the linear actuator 400 may be coupled to the caliper arm 302 through any suitable method, including through the usage of fasteners, adhesives, interlocking components, interference fit, and any combination thereof. In one or more embodiments, the linear actuator 400 may be indirectly coupled to the caliper arm 302 via the linkage 404. The linkage 404 may be any suitable component operable to connect the linear actuator 400 to the caliper arm 302. Without limitations, the linkage 404 may be a rod with pivots or hinges, or the linkage 404 may be a solitary component. In embodiments, an actuator plate 406 may be disposed at a distal end 408 of the linear actuator 400, wherein the actuator plate 406 may couple the linkage 404 to the linear actuator 400. The linkage 404 may be actuated to translate in response to operation of the linear actuator 400 through the actuator plate 406. The linkage 404 may comprise any suitable size, height, shape, and any combinations thereof. Further, the linkage 404 may comprise any suitable materials, such as metals, nonmetals, polymers, composites, and any combinations thereof. As illustrated, the linkage 404 may be coupled to the caliper arm 302. As the linkage 404 translates along the length of the housing 300, the caliper arm 302 may rotate about a hinge 410 accordingly. The hinge 410 may be disposed within the housing 300 and operate as a pivot point for the caliper arm 302.

As illustrated, there may be a spring 412 disposed between a first end 414 of the linkage 404 and the actuator plate 406. The spring 412 may be operable to bias the caliper arm 302 in the extended, second position away from the housing 300. During operations, as the linear actuator 400 operates, the linkage 404 may translate in accordance with the operation of the linear actuator 400. With reference to the present figures, the actuator plate 406, linkage 404, and spring 412 may translate in a first direction (for example, downhole). The caliper arm 302 may be actuated to rotate about the hinge 410 in a second direction (for example, extending radially outward) due to the coupling of the linkage 404 and the location of the hinge 410 with respect to the caliper arm 302. In embodiments wherein the caliper arm 302 is forced back towards the housing 300, the rotation along the hinge 410 back to the housing 300 may result in a corresponding linear translation of the linkage 404 in the second direction. Because the linear actuator 400 is not in operation, the spring 412 may compress between the actuator plate 406 and the first end 414 of the linkage 404 as the linkage 404 is displaced. When the caliper arm 302 is no longer experiencing a force capable of compressing the spring 412, the spring 412 may bias the caliper arm 302 back out to contact the borehole wall 306. A close spring 422 may be positioned between the actuator plate 406 and linkage 404 to provide a positive lock of the linkage 404 and caliper arm 302 when the caliper arm 302 is in the closed position.

In embodiments, the sensor 402 may indirectly monitor a position of the caliper arm 302 based on monitoring a position of the linkage 404. In other embodiments, the sensor 402 may directly monitor the position of the caliper arm 302. Without limitations, the sensor 402 may be selected from a group consisting of a proximity sensor, a potentiometer, a linear displacement sensor, a linear variable differential transformer, a Hall Effect transducer, a linear variable inductive transducer, a laser distance sensor, or any combination thereof. Depending on the type of sensor used as sensor 402, the sensor 402 may directly or indirectly monitor the caliper arm 302. In embodiments, the sensor 402 may be communicatively coupled to the telemetry module 128 (referring to FIG. 1). The sensor 402 may be operable to transmit measurements related to the position of the caliper arm 302 to the controller 130 (referring to FIG. 1) via the telemetry module 128. Once received by the controller 130, the processor 200 (referring to FIG. 2) of the controller 130 may be operable to determine a shape of the wellbore 104 by processing the measurements obtained of the borehole wall 306.

As illustrated, a first section 416 of the housing 300 may be open to the surrounding downhole environment, exposed to the drilling muds. A second section 418 may be closed, containing a volume of fluid for pressure compensation. In embodiments, there may be seals 420 disposed at interfaces to maintain the closed, second section 418. The second section 418 may be pressure balanced and compensated to adjust for changes in hydrostatic pressure.

Figure 5A:
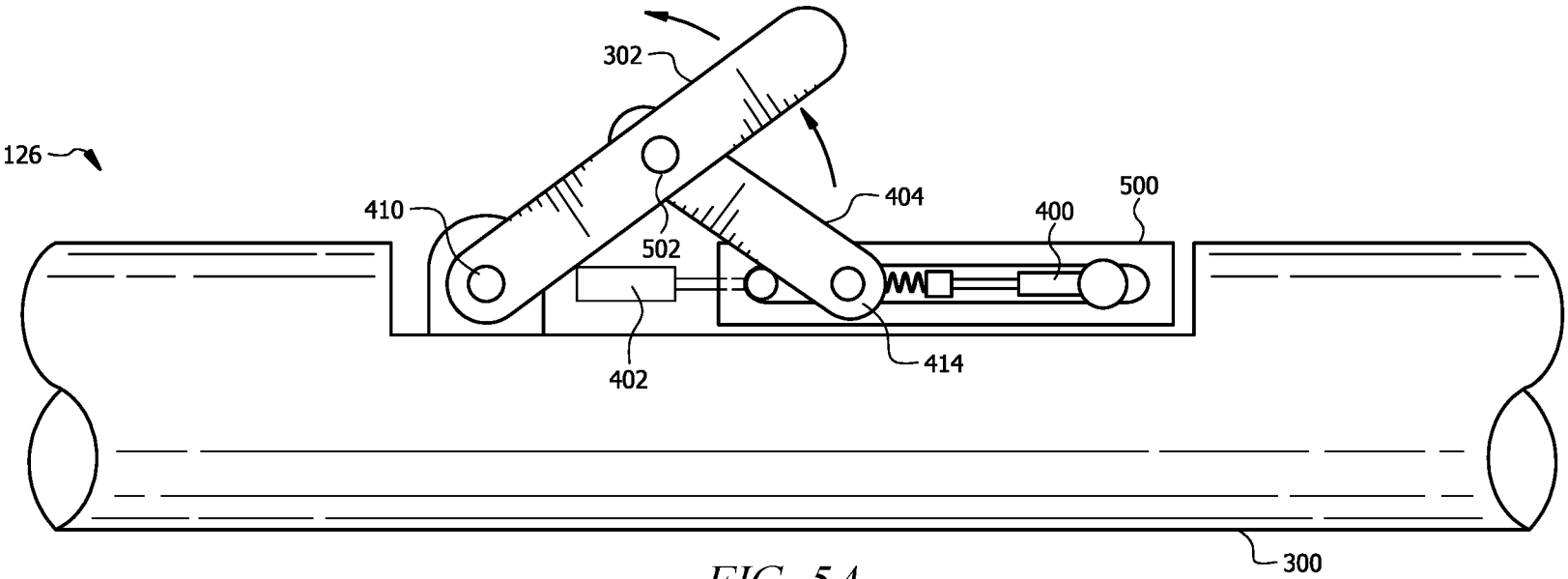
FIG. 5A is a diagram illustrating an example caliper arm in a second position extended away from a housing, according to aspects of the present disclosure.
Figure 5B:
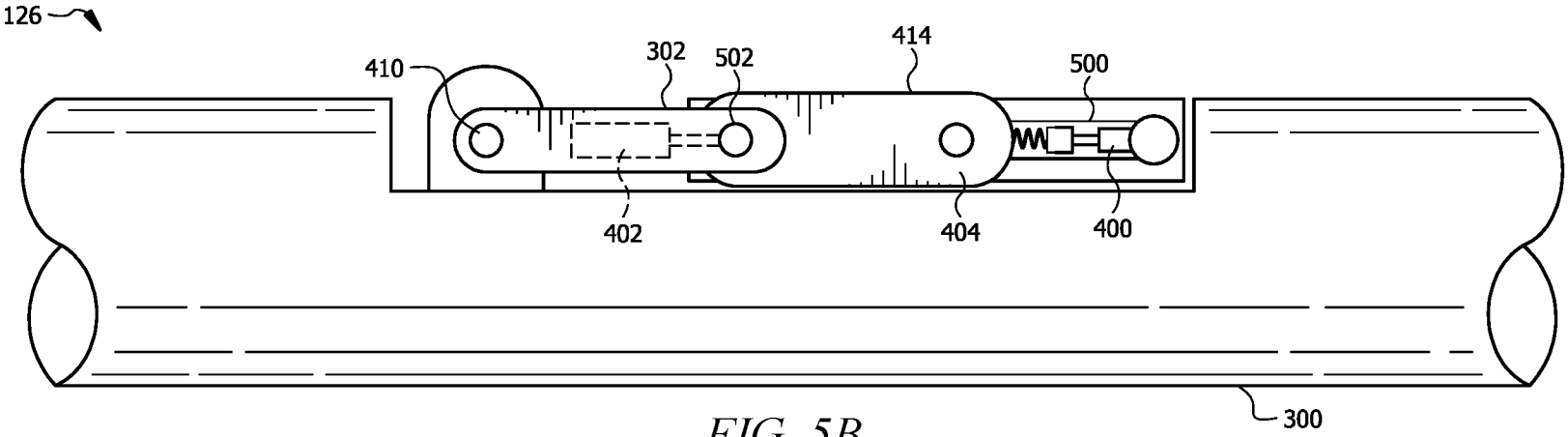
FIG. 5B is a diagram illustrating an example caliper arm in a first position within a housing, according to aspects of the present disclosure.

FIGS. 5A-5B are diagrams illustrating another example BHA 126 in operation. FIG. 5A illustrates the caliper arm 302 in the second position extended away from the housing 300. FIG. 5B illustrates the caliper arm 302 in the first position within the housing 300. With reference to each of FIGS. 5A and 5B, the BHA 126 may comprise the caliper arm 302, linear actuator 400, sensor 402, linkage 404, hinge 410, and a slot 500. The caliper arm 302, linear actuator 400, sensor 402, and linkage 404 as illustrated, may operate and function similarly as described with respect to FIGS. 4A-4C. As illustrated, the first end 414 of the linkage 404 may be disposed within the slot 500 and operable to translate along a length of the slot 500. The slot 500 may comprise an elongated aperture operable to receive the linkage 404 and provide for limited translation of the linkage 404. The slot 500 may be any suitable size, height, shape, and any combinations thereof. During operations, the linear actuator 400 may cause the first end 414 of linkage 404 to translate along the slot 500. Translation of linkage 404 may cause caliper arm 302 to extend outwards from housing 300, wherein a second end 502 of the linkage 404 may be coupled to the caliper arm 302. As caliper arm 302 is actuated to be displaced, the sensor 402 may indirectly monitor a position of the caliper arm 302 through monitoring the linkage 404.

Figure 6:
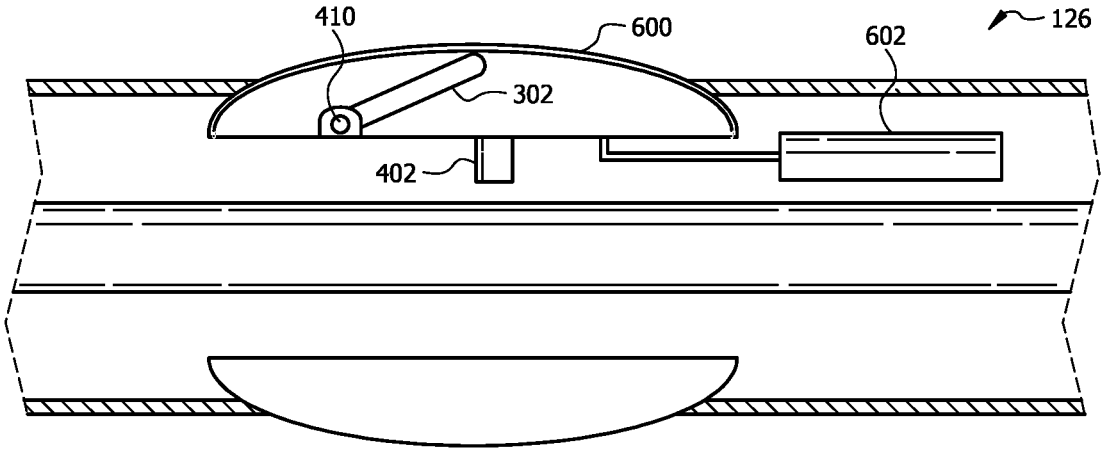
FIG. 6 is a diagram illustrating an example bottom hole assembly, according to aspects of the present disclosure.

FIG. 6 is a diagram illustrating another example BHA 126. The BHA 126 may comprise the caliper arm 302, sensor 402, hinge 410, an inflatable bladder 600, and a hydraulic actuator 602. The caliper arm 302, as illustrated, may operate and function similarly as described with respect to FIGS. 4A-4C. As illustrated, the caliper arm 302 may be disposed within the inflatable bladder 600. The inflatable bladder 600 may contain a fluid disposed therein and be operable to protect the caliper arm 302 from an external environment. The hydraulic actuator 602 may be operable to provide hydraulic pressure to the inflatable bladder 600. Any suitable component, such as a pump, may be utilized as the hydraulic actuator 602. In embodiments, the sensor 402 may be a pressure transducer operable to measure a pressure of the inflatable bladder 600. The BHA 126 may determine that a change in shape of the borehole wall 306 (referring to FIG. 3) may correspond to a change in the pressure of the inflatable bladder 600.

Figure 7:
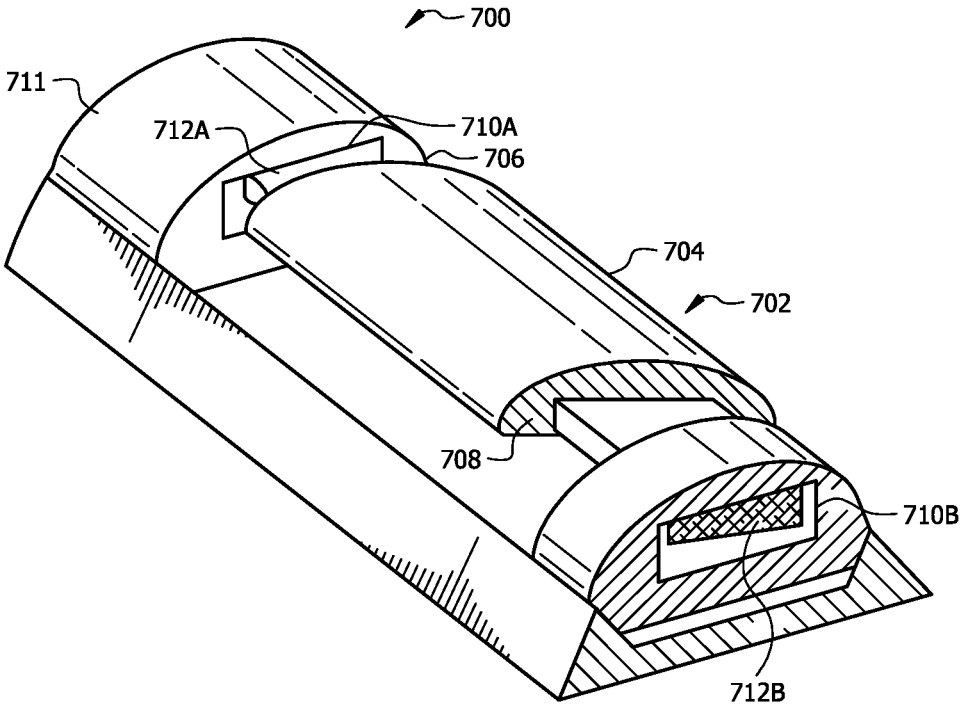
FIG. 7 is a diagram illustrating an example bottom hole assembly included in a rotary steering tool, according to aspects of the present disclosure.

FIG. 7 is a diagram illustrating another example BHA included in a rotary steering tool 700. In this embodiment, a pad pusher 702 may be operable as the previously described caliper arm 302 (referring to FIG. 3). As illustrated, the pad pusher 702 includes a steering pad 704 and may include a piston underneath (not shown). The steering pad 704 has a downhole side 706, an uphole side 708, and a pivot axis. The pivot axis may extend through a rotational center of a pivot coupling. The pad pusher 702 may thus be rotatable about the pivot axis between retracted and extended positions. As depicted the rotary steering tool 700 further includes a housing 711 having a motion restrictor 710 to restrict rotation about the pivot axis. The motion restrictor 710 may either be a first motion-limiting protrusion or a first retaining recess.

As illustrated in FIG. 7, the housing 711 couples the steering pad 704 of the pad pusher 702 to a tool collar. The housing 711 has a first retaining recess 710A extending through a cross-section of the housing 711. The first retaining recess 710A is configured to receive a first motion-limiting protrusion 712A of the pad pusher 702 therein. Similarly, the housing 711 has a second retaining recess 710B extending through a cross-section of the housing 711. In the same manner as the first retaining recess 710A, the second retaining recess 710B is configured to receive a second motion-limiting protrusion 712B of the pad pusher 702 therein. To this effect, the shapes of each of the first and second retaining recesses 710A and 710B are designed so as to allow the first and second motion-limiting protrusions 712A, 712B to rotate freely therein from a position of full retraction, to a position of full acceptable extension. The term "full acceptable extension" or as "full extension" can refer to a full extent to which the steering pad 704 can be pivoted outwards with respect to a central axis of the rotary steering tool 700 without the piston being displaced out of the piston bore.

Figure 8A:
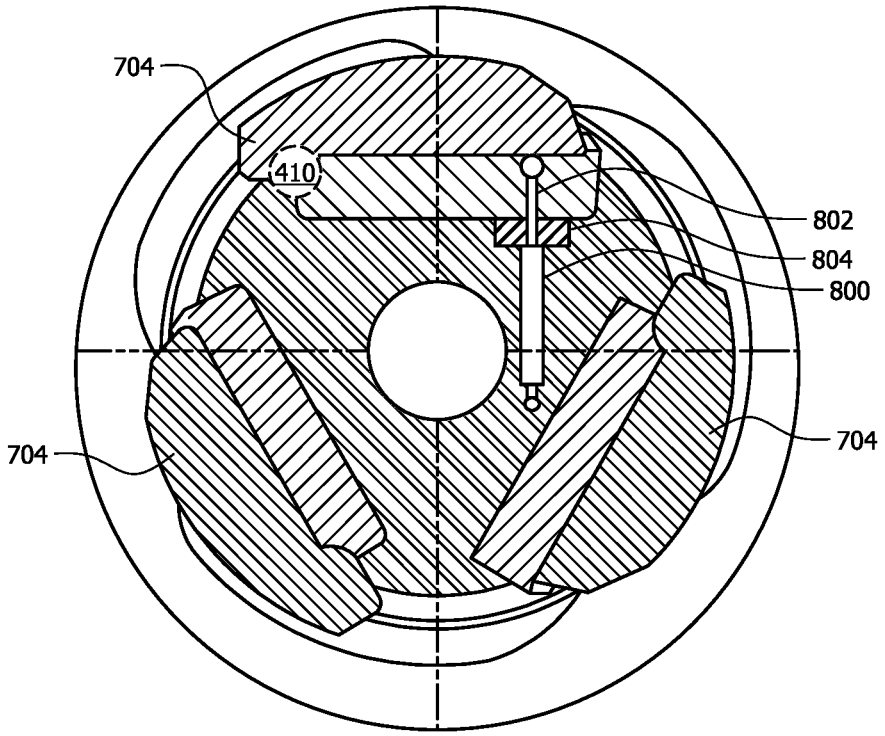
FIG. 8A is a diagram illustrating an example steering pad in a first position, according to aspects of the present disclosure.
Figure 8B:
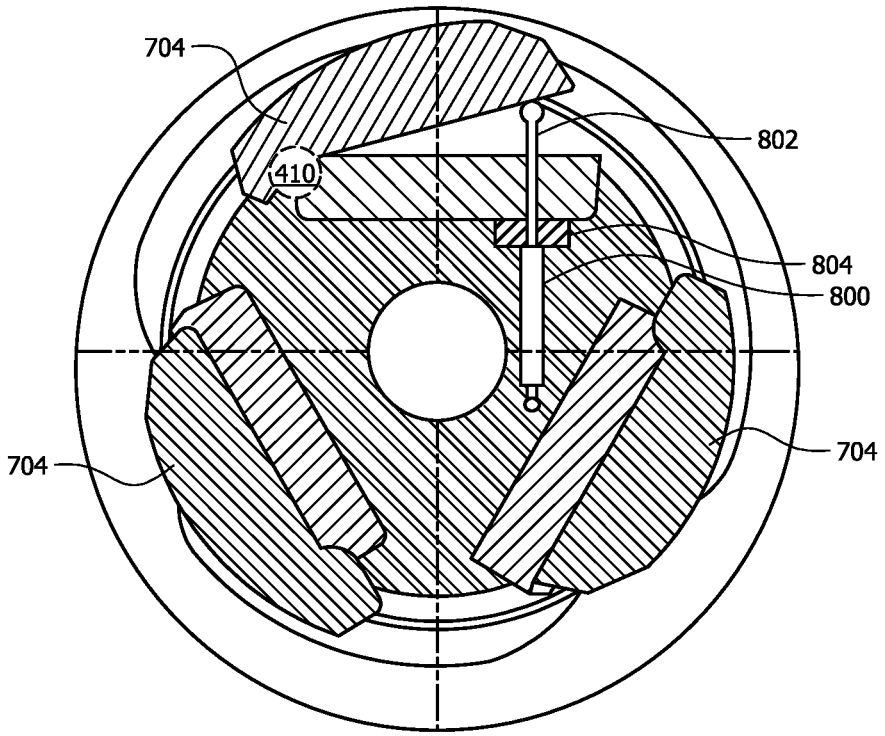
FIG. 8B is a diagram illustrating an example steering pad in a second position, according to aspects of the present disclosure.

FIG. 8A is a diagram illustrating an example steering pad 704 in a first position, and FIG. 8B is a diagram illustrating the example steering pad 704 in a second position. As described above, the caliper arm 302 (referring to FIG. 3) may be utilized to measure the radius or diameter of the wellbore 104 (referring to FIG. 1) using a mechanism that is in physical contact with the borehole wall 306 (referring to FIG. 3), by measuring the displacement of the arm 302 from a known reference (i.e., outer diameter of a downhole tool, center of a downhole tool).

An existing rotary steerable system (RSS) may comprise three steering pads 704 that are utilized to steer a drill bit. As the RSS and drill bit are rotated with applied weight on bit (WOB), the drill bit may penetrate the rock forward to deepen the wellbore 104. To steer the drill bit in a desired direction, the drill bit may be pushed sideways as it progresses forward. A valve may port drilling fluid from the bore of the RSS to the steering pad 704 that is rotating past the angular orientation opposite the desired steering direction of the drill bit, as each of the three pads 704 rotates past in turn. The steering pad 704 may comprise a sealed or close-fitting piston attached to which the pressure of the drilling fluid from the bore is applied by the valve. The outside of the steering pad 704 and piston may be exposed to annulus pressure that is lower than the bore pressure. The differential pressure may act to push the piston/pad 704 outward from the outer diameter of the RSS. One outer edge of the steering pad 704 may be attached to the RSS with the hinge 410. As the piston of the steering pad 704 is pushed outward by the differential pressure, the steering pad 704 may rotate about the hinge 410 and the outer surface of the steering pad 704 makes contact on the borehole wall 306 (referring to FIG. 3) with a steering force. As the steering pad 704 pushes on the borehole wall 306 with a steering force, the drill bit is pushed sideways in the direction opposite the steering force to steer the drill bit in the desired direction.

A sensor 800 may be mounted on or near each steering pad 704 to measure the displacement of the steering pad 704 from the outer diameter of the RSS when the steering pad 704 makes contact with the borehole wall 306. The sensor 800 may measure linear displacement of the steering pad 704 or piston, and/or the sensor 800 may measure rotational displacement of the steering pad 704 at the hinge 410. The downhole environment in which the displacement measurement is made may be harsh (i.e., high temperature; high pressure; drilling fluids (different types such as oil-based, diesel based, water based, invert/emulsion; chemical additives; conductive, non-conductive; corrosive; weighting solids, drilled solids, lost-circulation material, abrasive material, erosive material); high vibration, high shock; etc.). The sensor 800 may have a stated operating temperature range but may still be suitable for use outside the stated temperature range. Some sensors 800 may work even when exposed to high pressure, but still need to be protected from the drilling fluid by placing them in a chamber with a known compatible fluid (i.e., hydraulic oil) that is pressure compensated to the surrounding pressure, requiring a relatively thin wall chamber. Some sensors 800 may need to be packaged in a chamber that is isolated from both the drilling fluid and high pressure (i.e., atmospheric air, nitrogen, argon, vacuum), requiring a relatively thick wall chamber to not collapse under down hole pressure.

A sensor 800 protected by a chamber may be able to make a non-contact displacement measurement across the wall of the chamber (i.e., sensing a magnetic field), especially a thin wall chamber. Or the displacement of the steering pad 704 may need to be physically translated to the inside of the chamber to make the displacement measurement. In this case, a linear displacement measurement may utilize a rod 802 that is connected to or in contact with the piston/pad, with the rod 802 penetrating the wall of the chamber, having a seal 804 between the rod 802 and chamber wall, and the rod 802 moving linearly with the pad/piston. A rotational displacement measurement may utilize a rod or shaft that is connected to or is an extension of the hinge 410 or hinge pin of the steering pad 704, with the rod or shaft penetrating the wall of the chamber, having a seal between the rod or shaft and chamber wall, and the rod or shaft rotating with the pad/piston. In embodiments, the sensor 800 is a rotary displacement sensor disposed proximate the hinge 410 or another suitable hinge operable to measure the angular change along the hinge 410 in relation to the caliper arm 302 and/or pad 704.

The displacement of the steering pad 704 in an RSS that is forced into contact with the borehole wall 306 to steer the drill bit may be used as a mechanical caliper to measure the radius of the borehole wall 306 at the angular orientation of the steering pad 704 around the wellbore 104. The angular orientation of the steering pad 704 may be measured by the RSS using tool-face measurements (i.e., a sensor that measures angular orientation of the sensor relative to the gravity vector or angular orientation relative to the earth's magnetic field, plus the known angular offset of the pad from the angular orientation sensor). While steering the drill bit, each steering pad 704, in turn, may be forced into contact with the borehole wall 306 as the steering pad 704 rotates past the angular orientation opposite the desired steering direction of the drill bit. While steering the drill bit, each steering pad 704 in turn is in contact with the borehole wall 306 across an arc of angular orientation, such as 90° or 120° in range, the range being distributed both before and after the target angular orientation required to steer the drill bit in the desired direction. While steering, the acting mechanical caliper in the RSS may measure the radius of the borehole wall 306 across this arc where the steering pad 704 is in physical contact with the wellbore 104.

When steering the drill bit is not desired (i.e., drilling straight) the valve ports the drilling fluid to the steering pad 704 in a way that distributes the steering pad 704 force in angular orientations that continuously roll around the wellbore 104, instead of in a specific angular orientation. The valve ports the drilling fluid to a continuously rolling angular orientation, and as each steering pad 704 in turn rotates past the rolling angular orientation of the valve, the steering pad 704 may be extended into contact with the borehole wall 306 across an arc. The acting mechanical caliper may then measure the radius of the borehole wall 306 for the full 360° around the wellbore 104.

In one or more embodiments with multiple pads 704, a caliper measurement may be made when not rotating, such as when tripping the drill string in or out of the wellbore 104, or when steering by sliding with a mud motor instead of an RSS. A sliding caliper measurement may be made at the discrete orientation of each steering pad 704 and may not cover the full 360° of angular orientation around the wellbore 104. More steering pads 704 distributed around the perimeter of the tool or BHA 126 may allow for a better measurement around the wellbore 104 while sliding.

In one or more embodiments, there may be limitations to using the pad 704 of an RSS as a mechanical caliper (for example, as the caliper arm 302). The pad 704 may be forced into contact with the borehole wall 306 at a high force that is required to steer the drill bit. The high force may cause wear to the outer surface of the pad 704 as the pad 704 rubs on the rock formations. The rock formation may also be enlarged by the high contact force from the pad 704. Both the pad wear and the wellbore wall enlargement may be accounted for to increase the accuracy of the borehole wall 306 radius or diameter measurement. The high pad force may also displace the RSS laterally across the wellbore 104 as well as deflect the RSS tool and bottom-hole assembly (BHA) 126 by bending. These effects may also be accounted for to increase the accuracy of the caliper measurement. In addition, while steering, the pad 704 may only be in contact with the borehole wall 306 across an arc of angular orientation rather than the desired 360° around the borehole wall 306 for the caliper measurement.

To overcome these limitations a separate, modified implementation of the RSS pad (or pads) may be utilized as a mechanical caliper. This mechanical caliper system may have only one pad 704 or multiple pads 704. On demand, when a caliper measurement of the radius or diameter of the wellbore 104 is desired, a different valve may be opened to continuously port drilling fluid from the bore of the mechanical caliper to the pad 704 or pads 704 (all pads at the same time). The pad 704 (or pads) may comprise a sealed or close-fitting piston attached to which the pressure of the drilling fluid from the bore is applied by the valve. The outside of the pad 704 (or pads) and piston may be exposed to annulus pressure that is lower than the bore pressure. The differential pressure (bore–annulus) may act to push the piston/pad (or pads) outward from the outer diameter (OD) of the mechanical caliper. One outer edge of the pad 704 (or pads) may be attached to the mechanical caliper with a hinge. As the piston of the pad 704 (or pads) is pushed outward by the differential pressure the pad 704 (or pads) may rotate about the hinge and the outer surface of the pad 704 (or pads) may make contact on the borehole wall 306. The contact force of the pad 704 (or pads) on the borehole wall 306 with the mechanical caliper may be much lower than with the pad 704 of the RSS. The pad 704 (or pads) may be continuously extended into contact with the borehole wall 306. As the BHA 126 may be rotated, the pad (or pads) displacement (linear or rotational) may be used to make a continuous measurement of the radius or diameter of the wellbore 104 for the full 360° of angular orientation around the wellbore 104. The limitations of using an RSS as a mechanical caliper such as pad wear, rock formation enlargement, displacement, deflection may be reduced in magnitude and the caliper measurement may be made for the full 360° around the wellbore 104 when rotating. Any two pads 704 that are positioned 180° apart in angular orientation, when combined, may make a two-point diameter measurement instead of a radial measurement for the full 360° around the wellbore 104 when rotating. The valve may be opened on command when desired to make a caliper measurement and closed (on command) at all other times. This feature may further reduce wear of the pad 704 and mitigates the need to account for such wear.

In one or more embodiments, advantages may comprise opening and closing pads 704 on demand, only when desired to make a caliper measurement, opening all pads 704 at the same time and make a full 360 degree measurement, instead of a single steering pad 704 being energized at a time, in one orientation arc; operating at lower pad force (for example, just enough to make contact (reducing pad wear, less enlargement of the rock formation by the pads, less deflection of the tool/BHA meaning tool will be more centered in the wellbore)), and making a 2-point diametral measurement.

An embodiment of the present disclosure is a bottom hole assembly, comprising: a housing; a caliper arm pivotally coupled to the housing at a hinge disposed within the housing, wherein the caliper arm is operable to rotate about the hinge between a first position within the housing and a second position external to the housing; a linear actuator coupled to the caliper arm and operable to extend the caliper arm to the second position, wherein the caliper arm is biased to remain in the second position in contact with a borehole wall; and a sensor disposed within the housing and operable to monitor a position of the caliper arm.

In one or more embodiments described in the preceding paragraph, further comprising a ball disposed at a distal end of the caliper arm operable to rotate when in contact with the borehole wall. In one or more embodiments described above, further comprising a stabilizer disposed adjacent to the housing operable to centralize the housing within a wellbore. In one or more embodiments described above, further comprising an inflatable bladder, wherein the caliber arm is disposed within the inflatable bladder. In one or more embodiments described above, further comprising a plurality of caliper arms disposed along the housing. In one or more embodiments described above, wherein the caliper arm is operable to extend radially from the housing at the hinge. In one or more embodiments described above, wherein the caliper arm is operable to extend tangentially from the housing at the hinge. In one or more embodiments described above, further comprising a linkage coupling the linear actuator to the caliper arm. In one or more embodiments described above, wherein a first end of the linkage is disposed in a slot and operable to translate along a length of the slot, wherein the first end is coupled to the linear actuator, wherein a second end of the linkage is coupled to the caliper arm. In one or more embodiments described above, further comprising: an actuator plate disposed at an end of the linear actuator and coupled to the linkage; and a spring disposed between a first end of the linkage and the actuator plate. In one or more embodiments described above, wherein the sensor is selected from a group consisting of a proximity sensor, a potentiometer, a linear displacement sensor, a linear variable differential transformer, a Hall Effect transducer, a linear variable inductive transducer, a laser distance sensor, or a combination thereof. In one or more embodiments described above, wherein the caliper arm is a pad used by a rotary steerable system, and wherein the sensor is a rotary displacement sensor or a linear displacement sensor.

Another embodiment of the present disclosure is a method of determining a shape of a borehole, comprising: actuating a linear actuator to displace a linkage coupling the linear actuator to a caliper arm; rotating the caliper arm about a hinge disposed within a housing from a first position to a second position; monitoring a position of the caliper arm with a sensor communicatively coupled to a controller; transmitting measurements to the controller; and determining the shape of the borehole based on the measurements received from the sensor.

In one or more embodiments described in the preceding paragraph, further comprising extending the caliper arm radially from the housing. In one or more embodiments described above, further comprising extending the caliper arm tangentially from the housing. In one or more embodiments described above, wherein displacing the linkage comprises of translating a first end of the linkage coupled to the linear actuator along a length of a slot, wherein a wherein a second end of the linkage is coupled to the caliper arm. In one or more embodiments described above, further comprising biasing the caliper arm to remain extended in the second position with a spring. In one or more embodiments described above, further comprising compressing the spring in response to the caliper arm encountering a portion of a borehole wall with a smaller diameter. In one or more embodiments described above, wherein the sensor is selected from a group consisting of a proximity sensor, a potentiometer, a linear variable differential transformer, a linear displacement sensor, a Hall Effect transducer, a linear variable inductive transducer, a laser distance sensor, or a combination thereof. In one or more embodiments described above, wherein the caliper arm is a pad used by a rotary steerable system, and wherein the sensor is a rotary displacement sensor or a linear displacement sensor.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A bottom hole assembly, comprising:

a housing;

a caliper arm pivotally coupled to the housing at a hinge disposed within the housing, wherein the caliper arm is operable to rotate about the hinge between a first position within the housing and a second position external to the housing;

a linear actuator coupled to the caliper arm and operable to extend the caliper arm to the second position, wherein the caliper arm is biased to remain in the second position in contact with a borehole wall, and wherein the linear actuator is positioned axially relative to the caliper arm and parallel to a central axis of the bottom hole assembly; and a sensor disposed within the housing and operable to monitor a position of the caliper arm.

2. The bottom hole assembly of claim 1, further comprising a ball disposed at a distal end of the caliper arm operable to rotate when in contact with the borehole wall.

3. The bottom hole assembly of claim 1, further comprising a stabilizer disposed adjacent to the housing operable to centralize the housing within a wellbore.

4. The bottom hole assembly of claim 1, further comprising an inflatable bladder, wherein the caliber arm is disposed within the inflatable bladder.

5. The bottom hole assembly of claim 1, further comprising a plurality of caliper arms disposed along the housing.

6. The bottom hole assembly of claim 1, wherein the caliper arm is operable to extend radially from the housing at the hinge.

7. The bottom hole assembly of claim 1, wherein the caliper arm is operable to extend tangentially from the housing at the hinge.

8. The bottom hole assembly of claim 1, further comprising a linkage coupling the linear actuator to the caliper arm.

9. The bottom hole assembly of claim 8, wherein a first end of the linkage is disposed in a slot and operable to translate along a length of the slot, wherein the first end is coupled to the linear actuator, wherein a second end of the linkage is coupled to the caliper arm.

10. The bottom hole assembly of claim 8, further comprising:

an actuator plate disposed at an end of the linear actuator and coupled to the linkage; and a spring disposed between a first end of the linkage and the actuator plate.

11. The bottom hole assembly of claim 1, wherein the sensor is selected from a group consisting of a proximity sensor, a potentiometer, a linear displacement sensor, a linear variable differential transformer, a Hall Effect transducer, a linear variable inductive transducer, a laser distance sensor, or a combination thereof.

12. The bottom hole assembly of claim 1, wherein the caliper arm is a pad used by a rotary steerable system, and wherein the sensor is a rotary displacement sensor or a linear displacement sensor.

13. A method of determining a shape of a borehole, comprising:

actuating a linear actuator to displace a linkage coupling the linear actuator to a caliper arm, wherein the linear actuator is positioned axially relative to i) a hinge, ii) the linkage, or both;

rotating the caliper arm about the hinge disposed within a housing from a first position to a second position;

monitoring a position of the caliper arm with a sensor communicatively coupled to a controller;

transmitting measurements to the controller; and determining the shape of the borehole based on the measurements received from the sensor.

14. The method of claim 13, further comprising extending the caliper arm radially from the housing.

15. The method of claim 13, further comprising extending the caliper arm tangentially from the housing.

16. The method of claim 13, wherein displacing the linkage comprises of translating a first end of the linkage coupled to the linear actuator along a length of a slot, wherein a second end of the linkage is coupled to the caliper arm.

17. The method of claim 13, further comprising biasing the caliper arm to remain extended in the second position with a spring.

18. The method of claim 17, further comprising compressing the spring in response to the caliper arm encountering a portion of a borehole wall with a smaller diameter.

19. The method of claim 13, wherein the sensor is selected from a group consisting of a proximity sensor, a potentiometer, a linear variable differential transformer, a linear displacement sensor, a Hall Effect transducer, a linear variable inductive transducer, a laser distance sensor, or a combination thereof.

20. The method of claim 13, wherein the caliper arm is a pad used by a rotary steerable system, and wherein the sensor is a rotary displacement sensor or a linear displacement sensor.

* * * * *